United States Patent [19]

Rutkowski

[11] Patent Number: 4,651,484

[45] Date of Patent: Mar. 24, 1987

[54] FURNITURE CHANNEL

[75] Inventor: Edward J. Rutkowski, Kenmore, N.Y.

[73] Assignee: National Gypsum Company, Dallas, Tex.

[21] Appl. No.: 846,130

[22] Filed: Mar. 31, 1986

[51] Int. Cl.[4] ..... E05D 7/06

[52] U.S. Cl. ..... 52/241; 52/350; 52/738

[58] Field of Search ..... 52/238.1, 241, 732, 52/720, 346, 347, 481, 738, 348, 349, 350, 664

[56] References Cited

FOREIGN PATENT DOCUMENTS 963226 2/1975 Canada ..... 52/241

2242538 3/1974 Fed. Rep. of Germany ..... 52/738

*Primary Examiner*—Carl D. Friedman

*Assistant Examiner*—Naoko N. Slack

*Attorney, Agent, or Firm*—Robert F. Hause

[57] ABSTRACT

A furniture channel for vertical disposition against horizontal framing members, with an intermittent raised bead on the furniture channel inner surface for selective, optional positioning, against the horizontal framing members, for obtaining the desired spacing of the furniture channel faces from the framing members.

20 Claims, 3 Drawing Figures

Fig. 1
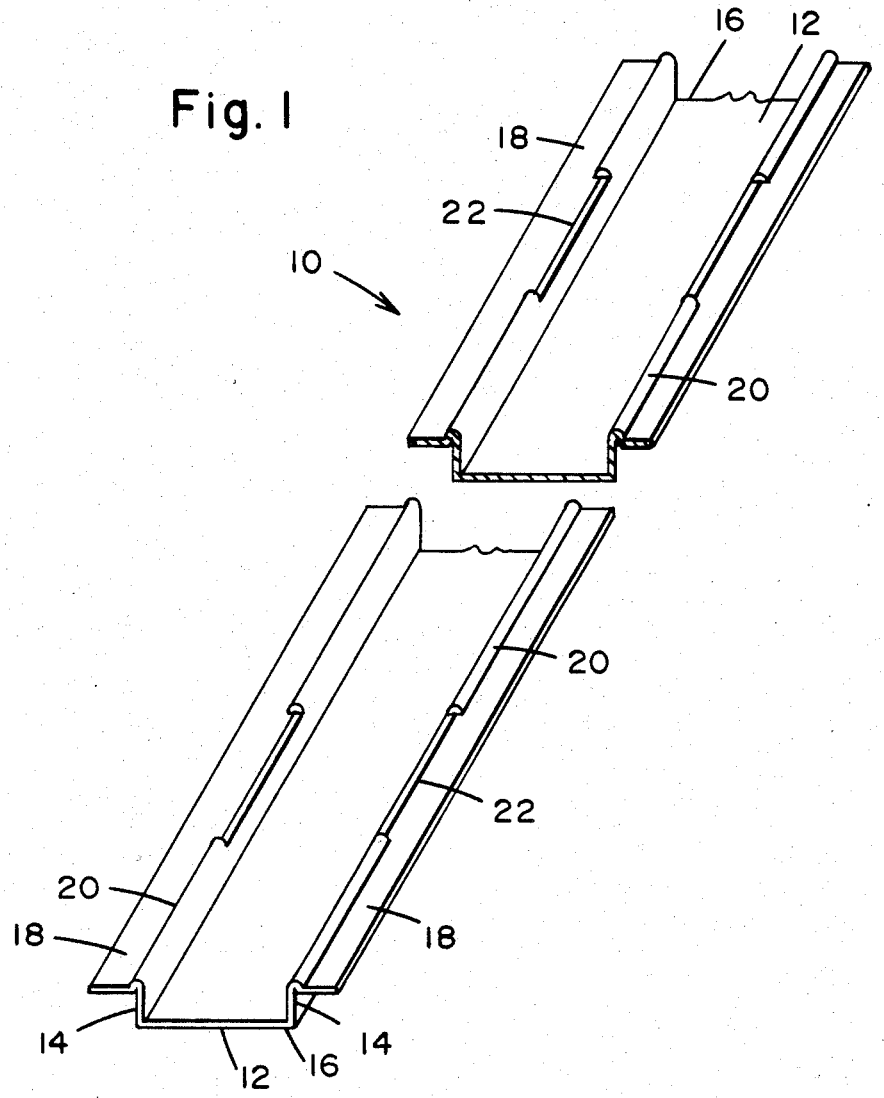
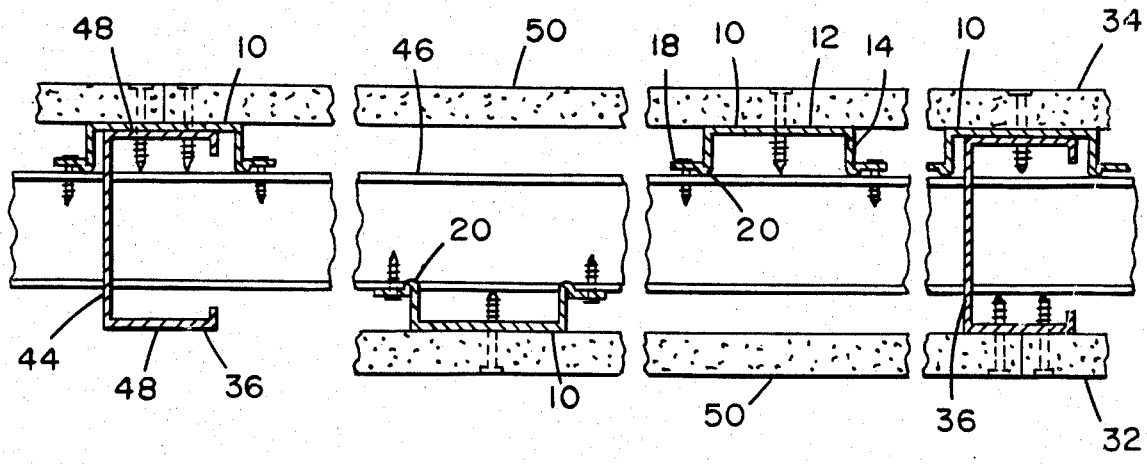
Fig. 3

FURNITURE CHANNEL

BACKGROUND OF THE INVENTION

This invention relates to an improved vertically disposed furniture channel, for use in combination with vertical metal studs and horizontal metal channels, having means on the furniture channel for mounting the furniture channel on the horizontal channels with the furniture channel face in the same wall plane as the vertical stud face or with the furniture channel face in the same wall plane as another furniture channel face of a furniture channel mounted over the face of a vertical stud.

An elongate sheet metal furniture channel, having a hat-shaped cross section, has been employed heretofore in a wall framing system consisting of vertical metal studs, mounted to extend from a floor to a ceiling, and horizontal reinforcing metal channels extending through holes in the webs of the vertical studs. The hat shaped furniture channels were mounted vertically with the two opositely directed flanges affixed against the horizontal reinforcing channel.

On some occasions, where heavier furniture is to be supported on the wall, for example, the furniture channels will also be mounted over the faces of the vertical studs. When this was done, the outer faces of the furniture channels mounted over the studs were not in the same plane as the outer faces of the furniture channels mounted against the horizontal channels, resulting in a wall built thereover being not completely flat.

SUMMARY OF THE INVENTION

The present invention is directed to modifying and improving upon the above described hat shaped furniture channels, providing means for mounting the channels on the horizontal reinforcing channels at two optional positions, overcoming the problem of the furniture channel faces being in different planes when some are placed over a stud face.

The invention consists essentially of a furniture channel of a hat-shaped cross section, having, additionally, a small rib located along each flange, with spaced portions of the ribs omitted, whereby the furniture channel can be mounted with either ribbed portions or plain unribbed portions abutting the horizontal channels, providing optional positions for the furniture channels.

It is an object of the invention to provide an improved furniture channel having two optional mounting positions.

It is a further object to provide a method of mounting furniture channels which permits all framework elements on which wallboard is mounted to be in the same plane whether a furniture channel is mounted over a stud face or not.

BRIEF DESCRIPTION OF THE DRAWINGS

FIG. 1 is an isometric view of a strip of furniture channel embodying the present invention.

FIG. 3 is a horizontal sectional view of the partition wall of FIG. 2, taken along line 3—3.

DESCRIPTION OF THE PREFERRED EMBODIMENTS

Figure 2:
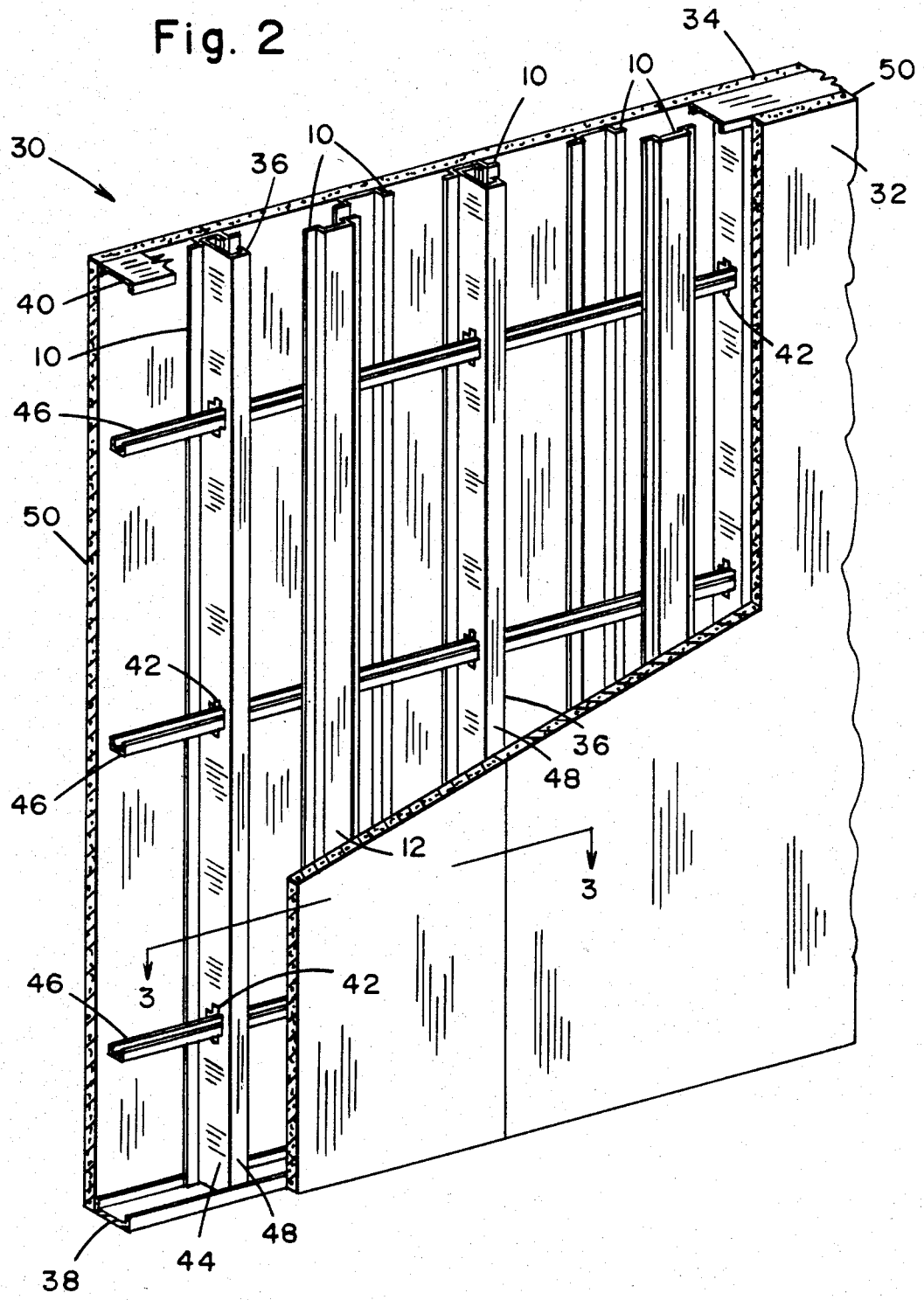
FIG. 2 is an isometric view of a partition wall, portions being broken away, having the furniture channels of FIG. 1 included therein, in accordance with the invention.

Referring to FIG. 1 there is shown an elongate sheet metal furniture channel 10, formed from, preferably, 20 gauge galvanized steel, and formed as a one-piece unit, including a central face section 12, a pair of webs 14, 14 extending perpendicularly rearwardly, one from each lateral edge 16, 16 of face section 12 and a pair of flanges 18, 18 extending outwardly from the rearward edge of each web 14, 14. The two flanges 18, 18 lie in a common plane, parallel and spaced from the plane of face section 12.

Each flange 18 includes a rearwardly protruding arcuate shaped, elongate bead portion 20, preferably at the inner edge of the flange 18 where flange 18 adjoins a web 14. The bead portion 20 is intermittent, with gaps 22, where short sections of the bead portion have been removed, located at equally spaced apart positions of 29 inches, center to center.

Referring to FIGS. 2 and 3 a partition wall 30 is shown, having a first side 32 and a second side 34. Wall 30 includes vertical metal studs 36 mounted between a floor runner 38 and a ceiling runner 40. Each stud 36 has a plurality of openings 42 in the web 44, which are located in equally spaced apart positions of 29 inches, center to center.

Upwardly opening elongate metal reinforcing channels 46, having a U-shaped cross-section, are located extending horizontally through a plurality of openings 42 in studs 36, resting on the bottoms of the openings 42, with the topmost reinforcing channel 46 located 20 inches from the ceiling runner 40.

A plurality of vertically extending furniture channels 10 are screw attached to each side of the plurality of horizontal reinforcing channels 46.

On the first side 32 of wall 30 the furniture channels 10 are located only at spaced positions in between studs 36. In order for the face section 12 of each furniture channel 10 to be in the same plane as the face section 48 of each stud 36, the furniture channel 10 is located with the gaps 22 immediately against the reinforcing channels 46.

On the second side 34 of wall 30, furniture channels are located at spaced positions in between studs 36 and also over each stud face section 48. These furniture channels 10 on the second side 34 are all located with the gaps 22 in between reinforcing channels 46, whereby the raised bead portions 20 rest immediately against the reinforcing channels 46. The presence of the raised bead portions 20 against the reinforcing channels 46 causes the furniture channnels 10 to all extend relatively further out from the reinforcinig channels 46 a distance which is sufficient for the furniture channels 10 located over studs 36 to be mounted firmly against the reinforcing channels, without interference from the presence of the stud 36. Thus, all the face sections 12 of the furniture channels 10 on the second side 34 are also in a common plane.

In the preferred embodiment, the stud 36 has a face section 48 which is about $1\frac{1}{4}$ inch to $1\frac{3}{8}$ inch wide and a stud depth, one face section to the opposite face section, of $2\frac{1}{2}$ inches. The reinforcing channel 46 is centered between the two opposite stud face sections and is $\frac{3}{4}$ inch in height and $1\frac{1}{2}$ inches in depth. The furniture channel 10 has a face section 12 which is 2 inches wide, flanges 18, 18 which have a width of $\frac{1}{2}$ inch, and webs 14, 14 which have a depth such that the depth of the furniture channel 10 from the plane of the inner surface of the flanges 18, 18 to the plane of the outer sruface of the face section 12 is ½ inch, the same as the distance from the plane of the reinforcing channel 46 to the plane of the stud face section 48.

The height of the bead portion 20 may be any amount equal to or greater than the thickness of the metal of the furniture channel face section 12, which is preferably a 20 gauge galvanized steel, or 0.036 inch. A 1/16 inch high bead provides substantial clearance between the furniture channel 10 and the stud face section 48.

As shown in broken away sections, gypsum wallboard 50 is screw attached to studs 36, with screws extending through both the furniture channel face section 12 and the stud face section 48 on the second side 34 of wall 30.

Furniture, such as shelves, desks, or benches are then hung from the walls with attaching means affixed by known means to the furniture channels located behind the wallboard 50.

Having compiled a detailed disclosure of the preferred embodiments of my invention, so that those skilled in the art may practice the same, I contemplate that variations may be made without departing from the essence of the invention.

I claim:

1. An elongate furniture channel for mounting vertically against a plurality of horizontal elongate framing members, said furniture channel comprising an inwardly disposed elongate base and an outwardly disposed elongate face section located in a fixed outwardly disposed plane relative to said base, said base having a plurality of raised elongate beads, extending inwardly from said base, said raised beads being intermittent, with gaps at spaced positions, whereby said furniture channel can be mounted against horizontal framing members with said gaps located at horizontal framing members or in between horizontal framing members for providing selective optional distances from horizontal framing members to said face section outwardly disposed plane.

2. An elongate furniture channel as defined in claim 1 wherein said inwardly disposed elongate base consists essentially of a pair of oppositely-directed flanges located in a common plane on opposite sides of said face section, spaced from the plane of said face section.

3. An elongate furniture channel as defined in claim 2 wherein said pair of flanges is connected to said face section by a pair of webs, each said web conecting the inner edge of a flange to an outer edge of said face section.

4. An elongate furniture channel as defined in claim 3 wherein said base includes one elongate raised bead located in each flange, extending inwardly from said flanges away from the plane of said face section.

5. An elongate furniture channel as defined in claim 4 wherein said elongate raised bead in each said flange is located immediately adjacent said web.

6. An elongate furniture channel as defined in claim 5 wherein said gaps in said beads are spaced apart, center to center, by about 29 inches.

7. An elongate furniture channel as defined in claim 5 wherein said face section is about 2 inches wide.

8. An elongate furniture channel as defined in claim 5 wherein said web has a width of about one half inch.

9. A partition wall comprising vertical metal studs each having outwardly disposed elongate face sections, elongate horizontal channels extending through openings in the studs and elongate vertical furniture channels, as defined in claim 1, affixed to the sides of said horizontal channels, said furniture channels being located, on one side of said partition, only in between studs and not over any studs and having said spaced gaps in said beads located against said horizontal channels, said furniture channel face sections all being in the same plane as said stud face sections on said one side of said partition.

10. A partition wall as defined in claim 9 wherein said furniture channel inwardly disposed elongate base consists essentially of a pair of oppositely-directed flanges located in a common plane on opposite sides of said face section, spaced from the plane of said face section.

11. A partition wall as defined in claim 10 wherein said pair of flanges is connected to said face section by a pair of webs, each said web connecting the inner edge of a flange to an outer edge of said face section.

12. A partition wall as defined in claim 11 wherein said base includes one elongate raised bead located in each flange, extending inwardly from said flanges away from the plane of said face section.

13. A partition wall as defined in claim 12 wherein said elongate raised bead in each said flange is located immediately adjacent said web.

14. A partition wall as defined in claim 13 wherein said horizontal channels and said gaps in said beads are both spaced apart, center to center, by about 29 inches.

15. A partition wall comprising vertical metal studs each having outwardly disposed elongate face sections, elongate horizontal channels extending through openings in the studs and elongate vertical furniture channels, as defined in claim 1, affixed to the sides of said horizontal channels, said furniture channels being located, on one side of said partition, both in between studs and over all studs and having said spaced gaps in said beads located between horizontal channels with said beads located against said horizontal channels, said furniture channel face sections all being in a common plane which is spaced outwardly from the plane of said stud face sections on said one side of said partition.

16. A partition wall as defined in claim 15 wherein said furniture channel inwardly disposed elongate base consists essentially of a pair of oppositely-directed flanges located in a common plane on opposite sides of said face section, spaced from the plane of said face section.

17. A partition wall as defined in claim 16 wherein said pair of flanges is connected to said face section by a pair of webs, each said web connecting the inner edge of a flange to an outer edge of said face section.

18. A partition wall as defined in claim 17 wherein said base includes one elongate raised bead located in each flange, extending inwardly from said flanges away from the plane of said face section.

19. A partition wall as defined in claim 18 wherein said elongate raised bead in each said flange is located immediately adjacent said web.

20. A partition wall as defined in claim 19 wherein said horizontal channels and said gaps in said beads are both spaced apart, center to center, by about 29 inches.

* * * * *